United States Patent [19]

Barnett

[11] Patent Number: 4,584,848

[45] Date of Patent: Apr. 29, 1986

[54] CONTAINER

[76] Inventor: Eugene R. Barnett, 6268 Windsor Dr., Indianapolis, Ind. 46219

[21] Appl. No.: 548,328

[22] Filed: Nov. 3, 1983

[51] Int. Cl.[4] ..... F25D 3/10

[52] U.S. Cl. ..... 62/294; 220/67

[58] Field of Search ..... 62/457, 371, 294; 220/67, 66, 89 A

[56] References Cited

U.S. PATENT DOCUMENTS

| | | | |
|---|---|---|---|
| 3,417,573 | 12/1968 | Warner | 62/294 |
| 3,468,452 | 9/1969 | Khoury | 220/67 |
| 3,852,975 | 12/1974 | Beck | 62/294 |
| 3,970,068 | 7/1976 | Sato | 62/294 |
| 4,365,724 | 12/1982 | Walden | 220/67 |
| 4,433,791 | 2/1984 | Mulawski | 220/89 A |

*Primary Examiner*—William E. Wayner

[57] ABSTRACT

A self-cooling can with a double-chamber formed or drawn out of a single slug of material, the outer chamber having a relatively thin wall and the inner chamber having a relatively thicker wall, and each chamber being capped with a cap; and a spring-carried lance is provided for co-operation with the inner chamber cap to achieve a release of pressurized coolant from the inner chamber, achieving cooling by evaporation of the coolant.

1 Claim, 7 Drawing Figures

CONTAINER

BACKGROUND OF INVENTION

1. Field of the Invention

This invention relates to a container or disposable can in which two substance are separately packaged and carried. Such a container is of a general type for use in which one of the substances is the primary substance for whose packaging the container is used, and the other is for a cooling substance which renders the container self-cooling at time of use.

2. Description of the Prior Art

Such containers are shown in applicant's U.S. Pat. No. 3,309,890, applicant's U.S. Pat. No. 3,494,143, and applicant's U.S. Pat. No. 3,452,898, and also other U.S. Pat. Nos. 2,460,765 and 2,187,558; there are also other types of cooling devices, however, the disadvantages of these and other such known devices render these cooling devices impractical to manufacture or use and are not desirable from the aspect of safety or economy, and also these devices disadvantageously involve complex construction.

SUMMARY OF THE INVENTION

With the disadvantages and problems of the prior art cited, it is accordingly the object of the present invention to provide an improved, practical, and economical self-cooling can for ease of manufacturing and safety of useage.

BRIEF DESCRIPTION OF THE DRAWINGS

The inventive concepts are illustrated in the accompanying somewhat schematic drawings; and other objects and advantages of the invention will become apparent from the description which follows hereinafter, and in the drawings, description of the preferred embodiment, and claim. In the drawings:

DESCRIPTION OF THE PREFERRED EMBODIMENT

Figure 1:
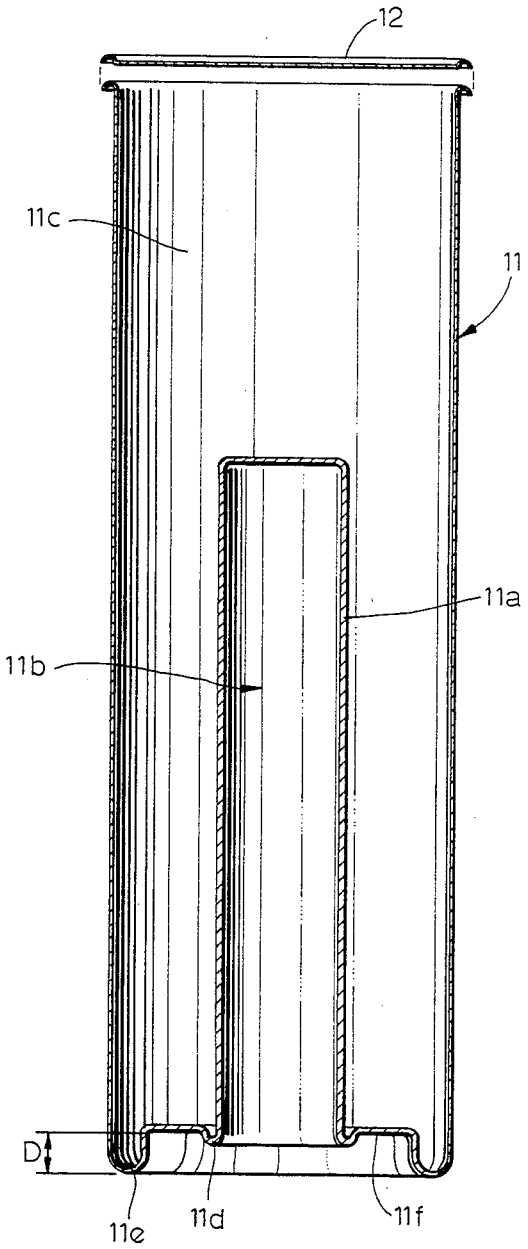
FIG. 1 is an axial cross-sectional view of a self-cooling can of the present invention, but without the device's inner cap installed.
Figure 2:
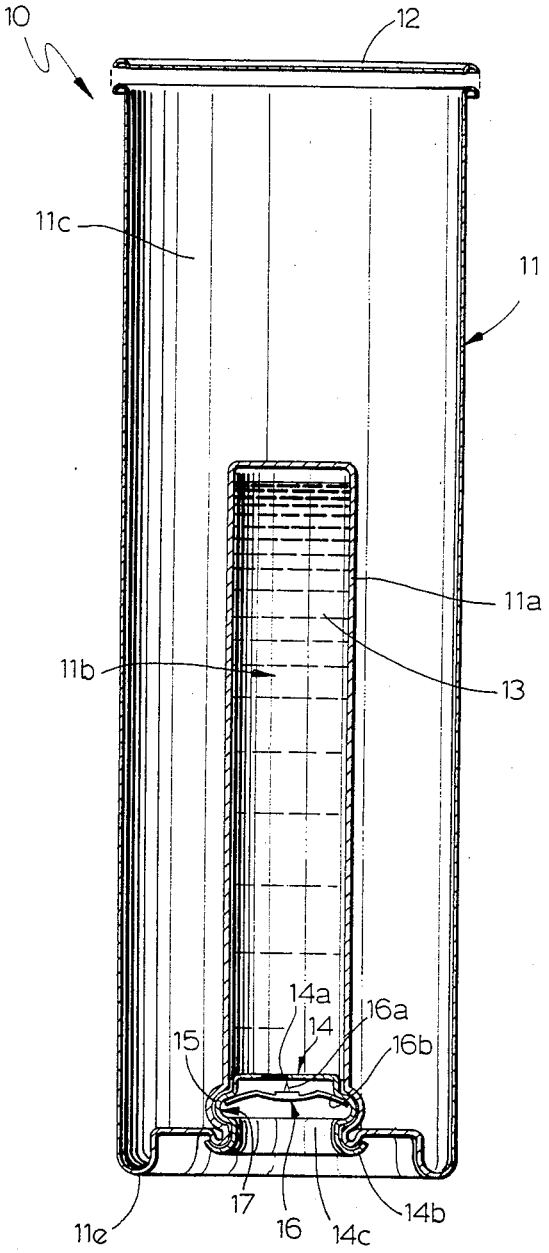
FIG. 2 is a similar cross-sectional view but with the inner cap and an actuator spring installed.
Figure 4:
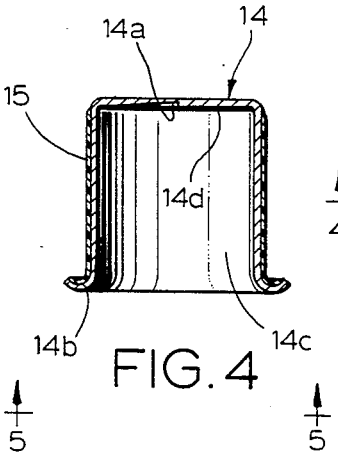
FIG. 4, in larger scale, is an axial cross-sectional view of the cap for the inner chamber of the device.
Figure 5:
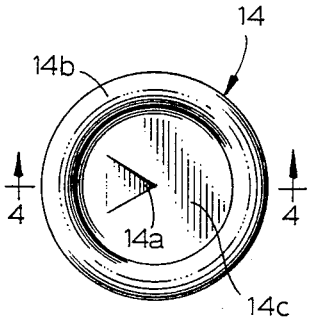
FIG. 5 is an outer end view of the cap of FIG. 4.
Figure 3:
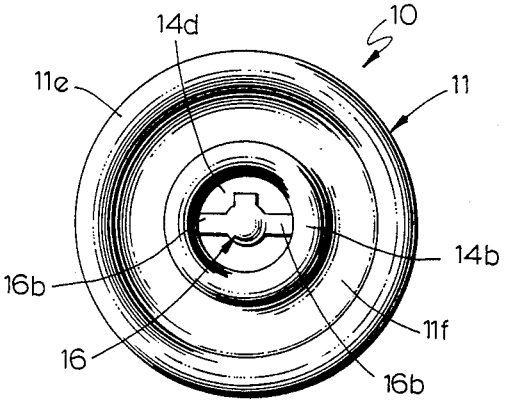
FIG. 3 is a botton view of the self-cooling can with the parts installed as shown in FIG. 2.

As shown in FIGS. 1 and 2, the invention provides a self-cooling can 10 with double chambers formed or drawn out of a single slug of material. The outer chamber has a relatively thin wall, and the inner chamber has a relatively thicker wall.

Drink or foodstuff is contained in the outer chamber 11*c* having outer walls 11, bottom rim 11*e*, and flat bottom area 11*f* from which extends a recessed protecting rim 11*d* and inner wall 11*a*. An outer cap or lid 12 is provided for the open end of the walls of the outer chamber 11*c*; and lid 12 may have any type of opening means.

The thicker walled inner chamber 11*b* holds the coolant material used to cool the surrounding drink or foodstuff in chamber 11*c* when coolant is released from chamber 11*b*.

Comparing FIG. 1 and FIG. 2, it will be noted that an inner cap 14 is provided, having a transverse wall, to close the open end of the inner chamber 11*b*.

The coolant in chamber 11*b* is sealed therein by two separate pressure sealing areas. That is, the inner cap 14 has sealant 15 applied under its lip 14*b* and on its side wall.

Inner cap 14 is inserted into the opening of the inner chamber walls 11*a*; and an expanding rolling tool means (not shown) is inserted into lid cavity 14*c*, and the outer side wall of 14 carrying sealant is expanded (17) outwardly.

Material elasticity of components 11*a* and 14 applies pressure on sealant 15, between the inner walls 11*a* and the side wall of the cap 14. Both the side walls of inner cap 14 and inner cavity wall 11*a* are expanded, as shown at 17, causing pressure on sealant 15 and the tightly pressed engagement of those walls to provide proper seal to prevent coolant from escaping. Also, inner cap 14's lip 14*b* with sealant is pulled downwardly over the rim 11*d* by elasticity of material in the side walls of cap 14 as it is expanded (17) by the expansion tool means (not shown); and thereby is attained another tight seal of the cap 14 onto the inner chamber 11*a*, by the sealant and the tightly pressing engagement of the lip 14*b* against the rim 11*d*.

The inner chamber cap 14 has a stamped "V" in cap 14's transverse wall 14*d* as shown in FIG. 4, FIG. 5, FIG. 6, and FIG. 7. The point 14*a* of the "V" is cut deeper in cap 14, and it is centered in cap 14's central area 14*c*. The "V"-cut in cap 14 is very thin at the apex or pointed end of the "V" 14*a* at the center of cap 14 area 14*c*. The "V"-cut acts as a safety valve, and will release pressure at a predetermined P.S.I. from coolant chamber 11*b* if needed, venting coolant before rupturing of wall 11*a* or its cap 14 occurs.

Figure 6:
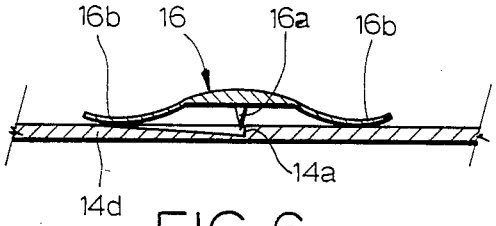
FIG. 6, in further enlarged scale, is a fragmental sectional view through a spring and the transverse wall of the cap for the inner chamber.

A lance 16*a* and retainer ears 16*b* are shown in FIG. 2, FIG. 3, FIG. 6, and FIG. 7. FIG. 2 shows a spring 16 installed in the outer opening of the inner cap or lid 14 with the lance 16*a* over the thin portion of cap 14 at the "V" apex 14*a*; and FIG. 6 shows the spring 16 with lance 16*a* at point of "V" 14*a* which when the spring 16 is depressed releases pressurized coolant from inner chamber 11*a*, causing outer chamber region 11*c* to be cooled. The coolant could be a coolant like Freon 12, (a trade-name coolant) or other coolants of similar properties of cooling by evaporation as the coolant emerges from the high pressure in inner chamber 11*b*.

Because the spring 16 is a spring it returns the lance 16*a* to rest, when force on the spring 16 is released, leaving a pre-determined size hole of proper dimension for proper coolant release rate for maximum cooling effect. Also, the spring 16 is much wider than lanc3 16*a*, and thus coolant cannot be sprayed directly outwardly from the opening caused by lance 16*a* because spring 16 acts as a deflector shield.

The spring 16 is held in position by spring ears 16*b* (FIG. 2, FIG. 3, FIG. 6, and FIG. 7); and FIG. 2 shows the spring 16 and its ears 16*b* in the position of expanded area 17 of cap 14, the spring 16 being retained by its ears 16*b* in that area 17.

Figure 7:
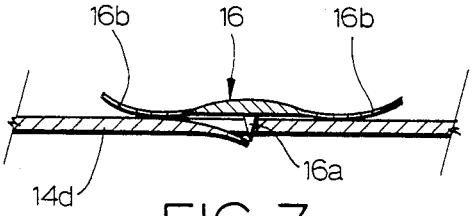
FIG. 7 is a frangmental sectional view as FIG. 6, but showing the spring lance penetrating the cap's transverse wall.

FIG. 6 shows the spring 16 at rest; and FIG. 7 shows the spring 16 and its lance 16*a* after the spring lance 16*a* has been depressed thus having penetrated the lipped cap scored section "V" and into the pressurized coolant chamber 11*b*.

As shown in FIG. 1 and FIG. 2, the outer extending can rim 11*e* extends outwardly a greater distance than the inner sealing rim 11*d*, as shown in FIG. 1, and the inner sealing rim 11*d* is thus protected by the outside rim 11*e* which acts as bumper.

It is thus seen that a disposable container according to concepts of the present invention provides novel and advantageous concepts and features, providing a disposable container having means for changing the temperature of the contents thereof.

Accordingly, it will thus be seen from the foregoing description of the invention according to this illustrative embodiment, considered with the accompanying drawings, that the present invention provides a new and useful disposable container, having desired advantages and characteristics, and accomplishing its intended objects, including those hereinbefore pointed out and others which inherent in the invention.

Modifications and variations may be effected without departing from the scope of the novel concepts of the invention; accordingly, the invention is not limited to the specific form or arrangement of parts herein described or shown.

What is claimed:

1. A Self-Cooling Container with an outer cappable chamber containing a drink or foodstuff, and an inner cappable chamber containing a pressurized coolant being formed or drawn from a material allowing continuous walls and bottoms of the outer chamber and of the inner chamber; the inner chamber being provided with thicker walls and bottom than the outer chamber;

the inner chamber being provided with a raised rim to recieve a cap; the outer chamber being of a greater diameter and the rim being extended farther outwardly than the inner chamber rim, to protect the inner chamber rim; a cap of commercial can type, capping the outer chamber; a cap provided with a lip and a sidewall to be recieved interiorly in the open area of the inner chamber; the lip having a sealant applied under the lip to be pulled downwardly upon the rim of the opening of the inner chamber and a sealant applied to the sidewalls of the cap in the area where the cap walls are expanded against the inner walls of the inner chamber, providing a double seal of the inner chamber; the inner chamber cap being scored exteriorly in a (V) form with the point of the (V) scored deeper and being centered in the center of the inner chamber cap, to provide a Safety Release of excessive pressure and to allow Intended Venting of the pressurized coolant to cause Cooling of the inner and outer chamber by evaporation; a spring carrying a centrally located lance of the proper size being placed interiorly in the exterior area of the inner chamber cap; this spring lance being retained in the inner chamber cap by force of spring urging on spring ends against cap walls; the depressing of the spring center area forces lance part of spring to move downwardly piercing the inner chamber cap at the point of the scored safety valve (V); when spring lance is released, spring force will retract lance; opening a hole of the Proper size into the inner chamber coolant area thereby releasing pressurized coolant to evaporate and cool inner and outer chambers and the material (drink or foodstuff) contained in the outer chamber; the spring body covers the opening made by the spring lance and will deflect all coolant released from inner chamber, giving a Safety shield effect.

* * * * *